United States Patent [19]

Baumgartner et al.

[11] Patent Number: 4,794,904

[45] Date of Patent: Jan. 3, 1989

[54] INTERNAL COMBUSTION ENGINE HAVING AN INJECTION NOZZLE FOR MIXTURE PREPARATION

[75] Inventors: Hans Baumgartner, Viersen; Rainer Südbeck, Wassenberg; Ulrich Henke, Übach-Palenberg, all of Fed. Rep. of Germany

[73] Assignee: Pierburg GmbH

[21] Appl. No.: 38,009

[22] Filed: Apr. 14, 1987

[30] Foreign Application Priority Data

Apr. 23, 1986 [DE] Fed. Rep. of Germany ..... 3613668

[51] Int. Cl.[4] ..... F02D 23/02

[52] U.S. Cl. ..... 123/564; 123/559.1

[58] Field of Search ..... 123/559, 564; 60/605.3; 418/83, 97, 100

[56] References Cited

U.S. PATENT DOCUMENTS 2,429,423 10/1947 Mock ..... 123/564

FOREIGN PATENT DOCUMENTS 176070 9/1953 Austria ..... 123/559

*Primary Examiner*—Stephen F. Husar

*Attorney, Agent, or Firm*—Toren, McGeady & Associates

[57] ABSTRACT

An internal combustion engine is provided with a volume-displacement supercharger. The supercharger has an interior with an inlet or suction side and an outlet side. An injection nozzle is located within a passage located directly in the supercharger and directs fuel into the supercharger interior at the suction end of the interior.

6 Claims, 2 Drawing Sheets

INTERNAL COMBUSTION ENGINE HAVING AN INJECTION NOZZLE FOR MIXTURE PREPARATION

TECHNICAL FIELD OF THE INVENTION

The invention relates to an internal combustion engine with a volume-displacement supercharger having an injection nozzle.

BACKGROUND OF THE INVENTION

From German Pat. 692 121 an internal combustion engine is known that has a supercharger consisting of a centrifugal blower in which an injection nozzle is arranged on the pressure side in the line leading from the supercharger to the engine, namely inside the blower directly after the rotor, at the beginning of a spiral that opens into a mixture line leading into one or more cylinders of the internal combustion engine. In this spiral, which serves to collect the output from the supercharger rotor and to convert its kinetic energy into energy of compression, the air has already been warmed enough to avoid ice formation, which could harm the supercharger and is often unavoidable when the mixture is injected into the suction line before the supercharger owing to the strong cooling of the air by the volatilisation of the fuel. This ice formation is particularly troublesome in the case of turbochargers running at high speed. The velocity of the air, which is important for producing turbulence and/or intimate mixing with the fuel, is of course lower on the pressure side of the supercharger than, for example, in the suction channel before the supercharger, and this is disadvantageous, particularly during idling when the velocity is low anyway. Nevertheless the air velocity is higher compared with an injection nozzle arranged still further from the supercharger on the pressure side, namely in the mixture line.

OBJECT OF THE INVENTION

The object of the invention is to obviate the disadvantages of known supercharged internal combustion engines with injection nozzles for producing the mixture, and to improve the production and distribution of the mixture, particularly when the internal combustion engine is idling.

SUMMARY OF THE INVENTION

According to the invention this object is achieved by means of an injection nozzle arranged in the supercharger on the suction side, advantageously in an idling passage. The fuel and the air drawn in are thereby mixed together on the suction side as late as possible, namely only right in the supercharger itself, so that high thermodynamic efficiency can be produced, since in the course of compression the best possible cooling is ensured by the volatilisation of the fuel. In addition the high air velocities on the suction side, with the highest air velocity, constant over the whole range of speeds and loads, prevailing in the idling or fresh air passage, can be utilised for intimate mixing and atomisation of the fuel.

The direction of injection from the nozzle is advantageously towards the working space of the supercharger. In the working space there is strong turbulence, which ensures further good mixing of the fuel injected from the nozzle or from the injection valve with the air. Any film or droplets of fuel that may build up on the rotor or on segments thereof defined by vanes and that could unduly change the composition of the mixture will be thrown off by the radial acceleration of the rotating rotor segments. Nevertheless the film of fuel that briefly wets the rotor segments has the desirable side effect of cooling both the rotor and the rotor vanes, thereby contributing on the one hand to better volumetric utilisation of the supercharger and on the other to better volatilisation of the fuel.

In a properly adjusted mechanical supercharger an air volume meter can be arranged in the suction line before the supercharger so that the amount of air introduced can be controlled, for example by a computer, according to the factors influencing the combustion conditions, so as to reduce the fuel consumption and/or to burn off a larger proportion of pollutants.

BRIEF DESCRIPTION OF THE DRAWINGS

The invention will now be described in more detail with reference to the embodiment shown by way of example in the drawings, in which.

DETAILED DESCRIPTION OF A PREFERRED EMBODIMENT OF THE INVENTION

Figure 1:
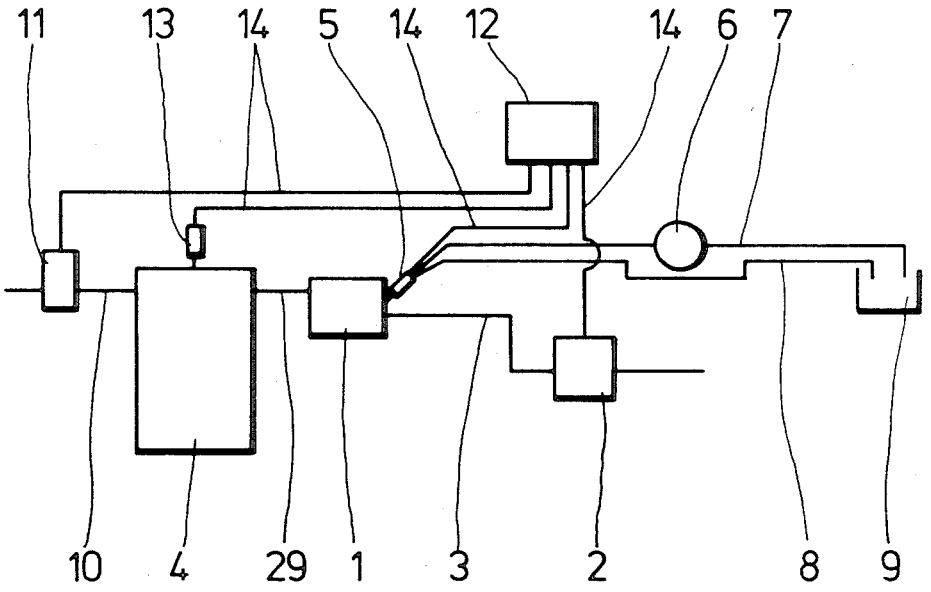
FIG. 1 shows a block diagram of an injection nozzle for mixture production and distribution incorporated in a supercharger of an internal combustion engine.
Figure 2:
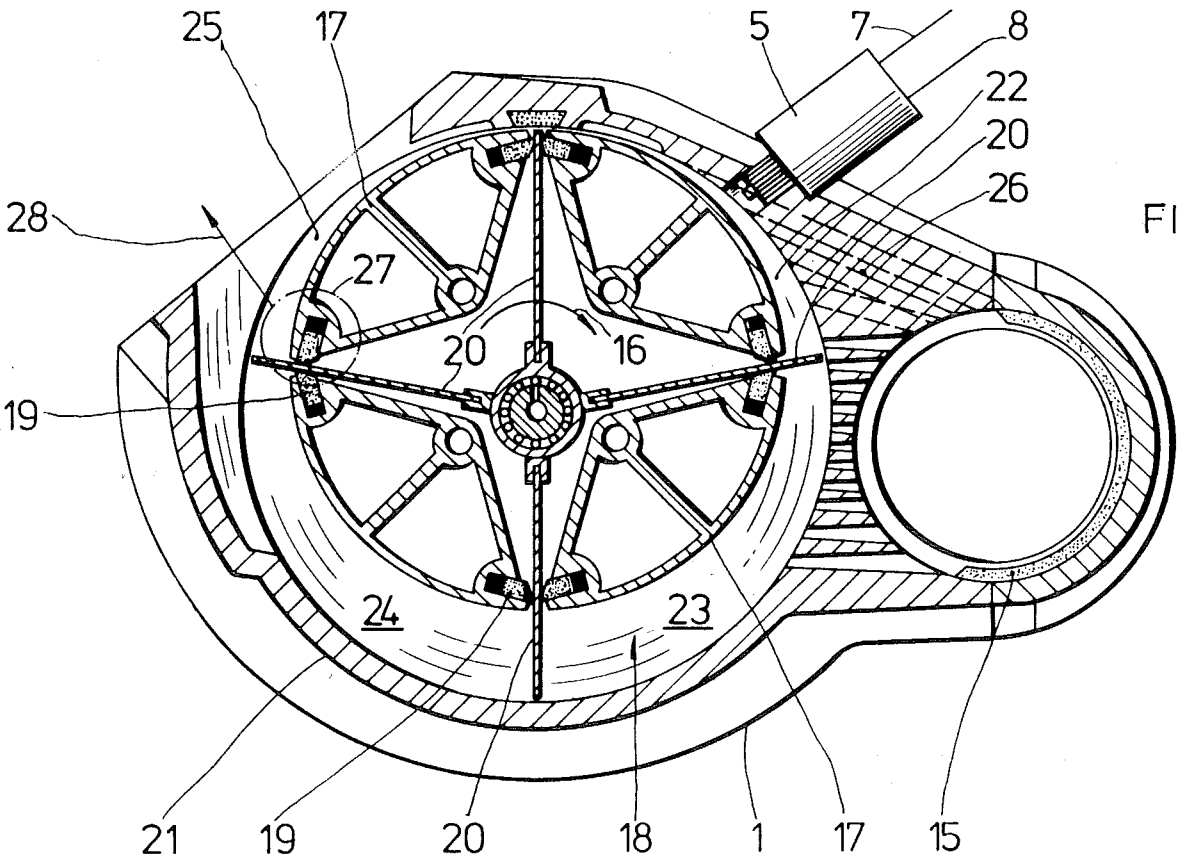
FIG. 2 shows, in section, a mechanical supercharger with an injection nozzle arranged in an idling passage.

A supercharger 1, arranged together with and after an air volume meter 2 in an intake line 3, provides or charges an internal combustion engine 4 with air. An injection valve 5 incorporated in the supercharger 1 is connected to a tank 9 via a supply line 7 having a fuel pump 6 and a return line 8. A measuring probe 11 fitted in an exhaust pipe 10 of the internal combustion engine 4 detects the pollutants present in the exhaust gas stream and transmits the data as an electrical signal to a control unit 12. The injection valve 5, the air volume meter 2 and the spark plugs 13 (one of which is shown in FIG. 1) associated with the cylinders of the internal combustion engine 4 are all connected, like the measuring probe 11, via control lines 14 to the control device 12 for computer evaluation of the data. When the measuring probe 11 registers an excessive emission of pollutants, various steps can be taken to achieve a permissible level of pollutants and/or lower fuel consumption; for example the gasoline injection or, depending on the quantity of air detected by the air volume meter as flowing into the supercharger (which is also important for the supercharging pressure) the charging of the internal combustion engine 4 by the supercharger 1 can be adjusted. For adjustment of the charging the supercharger has a rotary slide valve 15, shown in FIG. 2, to limit the introduction of air.

The supercharger 1 has a compressor wheel which is made up of an eccentrically mounted rotor 18 that is divided into four segments 17 and rotates in the direction of the arrow 16. During the rotation vanes 20, which are guided to slide between seals 19 between the segments 17, project to a greater or lesser extent from the body of the rotor according to the degree of rotation of the rotor 18, and divide the interior of the housing 21 accommodating the rotor 18 into four radial chambers 22, 23, 24, 25. The injection valve 5 is arranged in an idling or fresh air intake passage 26 with its direction of injection aiming into the radial chamber 22 that forms the working space. When the vanes 20 reach the position 27 indicated in FIG. 2 by a chain-dotted circle the air entrapped between them is expelled in the direction of the arrow 28 and passes into the charging line leading from the supercharger 1 to the internal combustion engine 4, or into the intake pipe 29 (FIG. 1) to charge the motor.

We claim:

1. An internal combustion engine with a volume-displacement supercharger having a fuel injection nozzle, said injection nozzle is arranged in a fresh air intake passage directly within the supercharger on a suction side thereof, and an air volume meter in an intake line opening into the supercharger.

2. An internal combustion engine according to claim 1 wherein the direction of injection of the nozzle is aimed into a working space of the supercharger.

3. An internal combustion engine according to claim 1 wherein said supercharger is an adjustable mechanical supercharger.

4. An internal combustion engine with a volume-displacement supercharger having a fuel injection nozzle, said supercharger comprises a housing having a cylindrically shaped interior, a rotor concentrally mounted within said interior and dividing said interior into separate chambers extending in the circumferential direction around the rotor from an inlet end to an outlet end spaced apart in the circumferential direction, an idling passage located within said housing and opening into one of said chambers adjacent the inlet end, and said injection nozzle located in said idling passage in said housing for directing fuel into the one of said chambers.

5. An internal combustion engine according to claim 4, wherein a rotary slide valve is mounted within said housing downstream of said idling passage and upstream from the outlet end for limiting the introduction of air into the housing interior.

6. An internal combustion engine according to claim 4, wherein said injection nozzle directs fuel in a generally radial direction into the one of said chambers in the interior of said housing.

* * * * *

UNITED STATES PATENT AND TRADEMARK OFFICE

CERTIFICATE OF CORRECTION

PATENT NO. : 4,794,904

DATED : January 3, 1989

INVENTOR(S) : Hans Baumgartner et al

It is certified that error appears in the above-identified patent and that said Letters Patent is hereby corrected as shown below:

In the heading of the Patent, it should read:

[75] Inventors: Hans Baumgartner, Viersen; Rainer Südbeck, Wassenberg; Ulrich Henke, Übach-Palenberg; Manfred Brandstädter, Düsseldorf, all of Fed. Rep. of Germany Signed and Sealed this Eleventh Day of July, 1989

*Attest:*

*Attesting Officer*

DONALD J. QUIGG

*Commissioner of Patents and Trademarks*